United States Patent [19]

Kuznetsov et al.

[11] 4,302,932

[45] Dec. 1, 1981

[54] ANNULAR COMBUSTOR OF GAS TURBINE ENGINE

[76] Inventors: Andrei L. Kuznetsov, ulitsa S. Kovalevskoi, 16/4, kv. 141; Anatoly V. Sudarev, Georgievskaya ulitsa, 2, kv. 57; Viktor V. Ivakhnenko, Tovarischesky prospekt, 4, kv. 373; Jury A. Lamm, ulitsa S. Kovalevskoi, 16, kv. 79; Vladimir A. Maev, ulitsa Granitnaya, 36, kv. 46; Jury I. Zakharov, ulitsa Butlerova, 24, kv. 40, all of Leningrad, U.S.S.R.

[21] Appl. No.: 81,369

[22] Filed: Oct. 3, 1979

[51] Int. Cl.[3] ..... F02C 7/20

[52] U.S. Cl. ..... 60/39.32; 60/39.36

[58] Field of Search ..... 60/39.32, 39.36, 39.31

[56] References Cited

U.S. PATENT DOCUMENTS

| | | | |
|---|---|---|---|
| 2,544,538 | 3/1951 | Mahnken | 60/39.32 |
| 2,710,523 | 6/1955 | Purvis | 60/39.32 |
| 2,760,338 | 8/1955 | Keast | 60/39.32 |
| 3,722,215 | 3/1973 | Zbdanov | 60/39.32 |

*Primary Examiner*—Douglas Hart
*Attorney, Agent, or Firm*—Lilling & Greenspan

[57] ABSTRACT

An annular combustor of a gas turbine engine comprising a front burner device located in the inlet section of the combustor and a flame tube, featuring a longitudinal split coinciding with that of the engine. The flame tube is formed by two concentric, outer and inner, shells with curvilinear surfaces. Each one of the shells is split longitudinally into sections, the places of the split being sealed with sealing members. In addition, the combustor is provided with at least two ring-shaped longitudinally-split load-bearing members for each one of the shells. The ring-shaped load-bearing member located in the zone of the combustor inlet section is capable of longitudinal and radial movements while the load-bearing member located in the zone of the combustor outlet section is capable of only radial movement. Each one of the shell sections is coupled with a respective ring-shaped load-bearing member, such that the middle portion of the section is rigidly attached to the ring-shaped member while the ends of said section are connected to the ring-shaped member with the provision for movement in the circumferential direction.

2 Claims, 11 Drawing Figures

ANNULAR COMBUSTOR OF GAS TURBINE ENGINE

The present invention relates to gas turbine engines and, more particularly, it relates to annular combustors.

This invention can be used most advantageously in stationary gas turbine engines.

BACKGROUND OF THE INVENTION

At present, gas turbine engines employ annular combustors built-in between the compressor and turbine. In so doing, the combustor has usually no longitudinal split and the gas turbine engine is assembled by way of successive assembly of stator parts while mounting the vanes simultaneously or assembling the turbine rotors, and disassembled in an inverse sequence. This results in an increased consumption of labor during manufacture and, especially, during the servicing of the engine, inasmuch as access to the engine elements for inspection and repair is rather difficult.

Therefore, the designers' efforts are aimed at developing annular combustors having a longitudinal split in the plane of the split of other engine components. In this respect one of, main difficulties are offered by the flame tube of the combustor which is, affected by high temperatures, and whose design should satisfy the requirement of enhanced stiffness while ensuring the freedom of thermal expansion of its components inasmuch as the failure to meet this requirement results in the loss of shape by the flame tube, emergence of thermal stresses and, as a consequence, the warping of the flame tube components and the formation in the latter of cracks causing the failure of both the combustor and the entire engine.

Attempts at developing annular combustors with compensation for thermal expansion of individual components resulted in the combustor according to British Pat. No. 799,605.

This prior art annular combustor comprises a burner device located in the combustor inlet section and a flame tube formed by two concentric, outer and inner, shells.

The outer shell is split into sections in the longitudinal direction. Each section has, along the line of split, alternating projections and recesses, meshing with each other upon the assembly of the shell to form a movable joint serving to partly compensate for thermal deformation of the combustor in the circumferential direction. In a large-size combustor, however, the outer shell lacks stiffness, which is characteristic of combustors of stationary gas turbine engines. This affects the reliability of operation of the combustor and of the entire gas turbine engine.

Also known in the art is another annular combustor for a gas turbine engine, whose design helps facilitate the assembly and maintenance of the engine due to a longitudinal split of the combustor whose plane coincides with that of the engine split (cf., Trudy Uralskogo turbomotornogo zavoda "Opyt sozdaniya turbin i dizelei"—Proceedings of Uralskii Turbine Engine Works on the "Turbines and Diesels. Design and Manufacturing Experience," No. 2, 1972, pp. 88–94).

Said latter prior art annular combustor includes a front burner device secured in the inlet section of the combustor and a flame tube formed by two concentric, outer and inner, shells with curvilinear surfaces. Each one of the shells is split into sections in the longitudinal direction, the places of split being sealed with sealing members in the form of two plates. The first one of said plates, a flat plate, is attached to one section with its one end and, with its other end, rests freely on another section. The other one of said plates is attached with its one end to the section on which the first plate rests freely and, with its other end, envelops the latter to form therewith and with the section a sliding mortise joint. For joining the sections of the outer and inner shells in the combustor inlet portion, provision is made of a load-bearing arrangement in the form of a massive frame having a longitudinal split and including several massive rings, at least one of which embraces the sections of the outer shell while at least one other ring embraces the sections of the inner shell. The rings are rigidly interconnected with ribs of which two, arranged at a longitudinal horizontal plane in each half of the frame split, form the split flange while part of the other ribs are used for fixing the frame in the engine casing.

For joining the sections of the outer and inner shells in the combustor outlet section provision is made of single load-bearing rings likewise fixed on the engine casing. In this manner, the load-bearing arrangement in the form of a circular frame and the load-bearing rings are rigidly secured on the engine casing to form an integral rigid system.

Upon the combustor operation, especially, under unsteady conditions, a considerable temperature difference is observed between the circular frame and shell sections, which results in the emergence of temperature expansions of the sections relative to each other and to the frame. Each section is secured in the rings having an annular groove by means of a bracket. Due to the rigid attachment of the frame and single load-bearing rings to the engine casing, the annular groove and brackets, simultaneously serve to compensate for temperature expansion in the radial, circumferential and longitudinal directions. Therefore, this attachment is rather complicated and practically fails to accomplish a reliable operation of the combustor due to the absence of necessary expansion gaps, which results in the emergence of thermal stresses causing the warping of the combustor, for example, in the inlet section thereof, and the loss of shape.

SUMMARY OF THE INVENTION

It is the object of the present invention to develop an annular combustor of a gas turbine engine, wherein provision is made for such a connection of the sections of the flame tube shells with load-bearing members as to preclude the emergence of stresses in the sections of the outer and inner shells of the combustor flame tube caused by thermal deformation while maintaining the enhanced stiffness of the flame tube.

In accordance with this object and other objects, the present invention resides in that in an annular combustor of a gas turbine engine, having a front burner device located in the inlet section of the combustor featuring a longitudinal split coinciding with that of the engine and a flame tube formed by two concentric, outer and inner, shells with curvilinear surfaces, each one of said shells being split longitudinally into sections while the places of the split are sealed with sealing members. Also, this is provided at least two ring-shaped longitudinally-split load-bearing members for each one of the shells. One of said load-bearing members is located in the zone of the combustor inlet section with a possibility of longitudinal and radial movement while the other one of said load-bearing members is located in the zone of the combustor outlet section with a possibility of radial movement, and each one of the shell sections is coupled with a respective ring-shaped load-bearing member, such that the middle portion of the section is rigidly attached to the ring-shaped member while the ends of said section are connected to the ring-shaped member with the provision for movement in the circumferential direction.

During the engine operation, there takes place in the combustor non-uniform heating of the outer and inner shells, ring-shaped load-bearing members and the engine casing. The maximum temperature is observed on the outer and inner shells of the flame tube while the highest temperature difference occurs between the outer and inner shells and the ring-shaped load-bearing members.

In order to eliminate the difference in radial temperature expansions between the outer and inner shells of the combustor flame tube and the ring-shaped load-bearing members, the shells are made split, consisting of separate sections provided with an appropriate gap therebetween, with said gap being sealed with sealing members which do not prevent the relative expansion of the sections upon heating. Nevertheless, this is insufficient for a reliable combustor operation inasmuch as a series of rather complex relative movements are to be further compensated for upon temperature expansion between the sections of the outer and inner shells, ring-shaped load-bearing members and the engine casing, called upon to rule out the possibility of stresses emerging in the sections of the flame tube shells as a result of thermal deformations and, at the same time, maintain the geometric shape of the shells under working conditions.

In the combustor according to the present invention, simple means are employed to provide for the compensation of the relative movement upon temperature expansion such as, first, in the circumferential direction between the shell sections due to attaching the sections of the outer and inner shells to the respective ring-shaped load-bearing members in such a manner that the middle portion of the section is rigidly attached to the ring-shaped load-bearing member while the section ends are connected to the ring-shaped member with provision for movement in the circumferential direction and, at the same time, restrained in the radial direction and, second, in the longitudinal and radial directions between the ring-shaped load-bearing members and the engine casing due to the provision of at least two ring-shaped load-bearing members for each one of the shells. One of said load-bearing members is located in the zone of the combustor inlet section with a possibility of longitudinal and radial movement, while the other one of said load-bearing members is located in the zone of the combustor outlet section with a possibility of radial movement permitting of fully compensating for the temperature expansion difference between the shell sections, ring-shaped load-bearing members and the engine casing.

The afore-described means serve to preclude the emergence of stresses caused by thermal deformation and increase the stiffness of the structure, thereby considerably improving the reliability of operation of an annular combustor having a longitudinal split, as well as of the overall operation of the gas turbine engine.

BRIEF DESCRIPTION OF THE DRAWING

Other objects and advantages of the present invention will be more apparent upon considering the following detailed description of an exemplary embodiment thereof, reference being had to the accompanying drawings in which.

DESCRIPTION OF THE PREFERRED EMBODIMENTS

Figure 1:
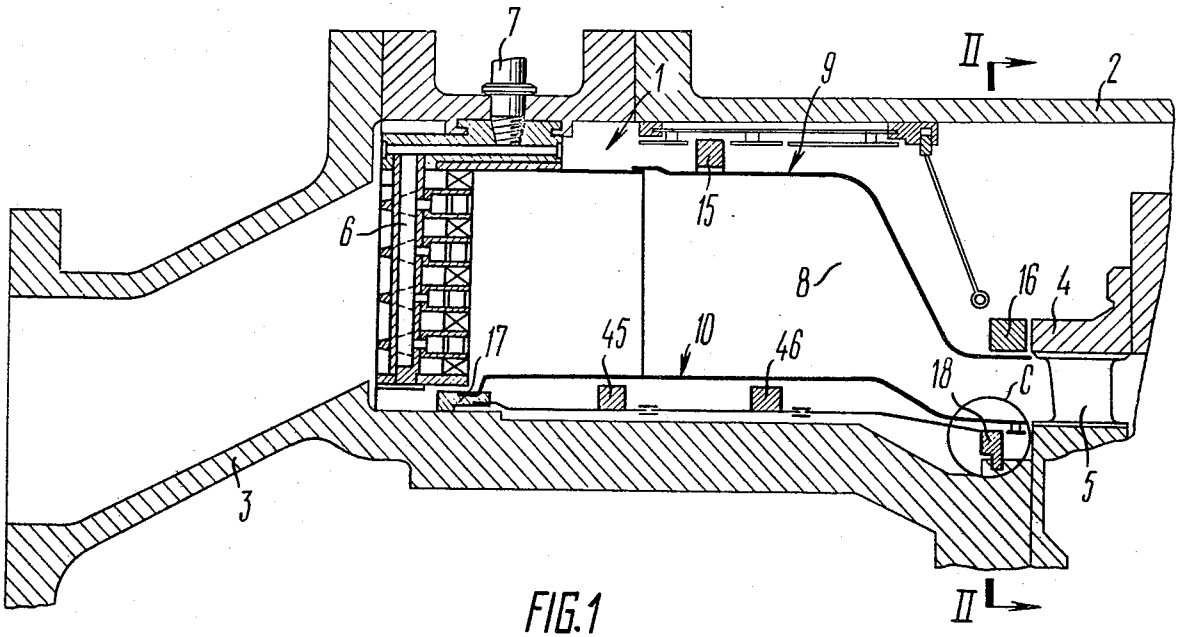
FIG. 1 is a diagrammatic view of the annular combustor according to the present invention, with the view being in longitudinal section.

Referring now to FIG. 1 of the accompanying drawings, an annular combustor 1 is mounted in a casing 2 of a gas turbine engine and is located between a diffusor 3 of the compressor and a housing 4 of a gas turbine stator 5.

Figure 2:
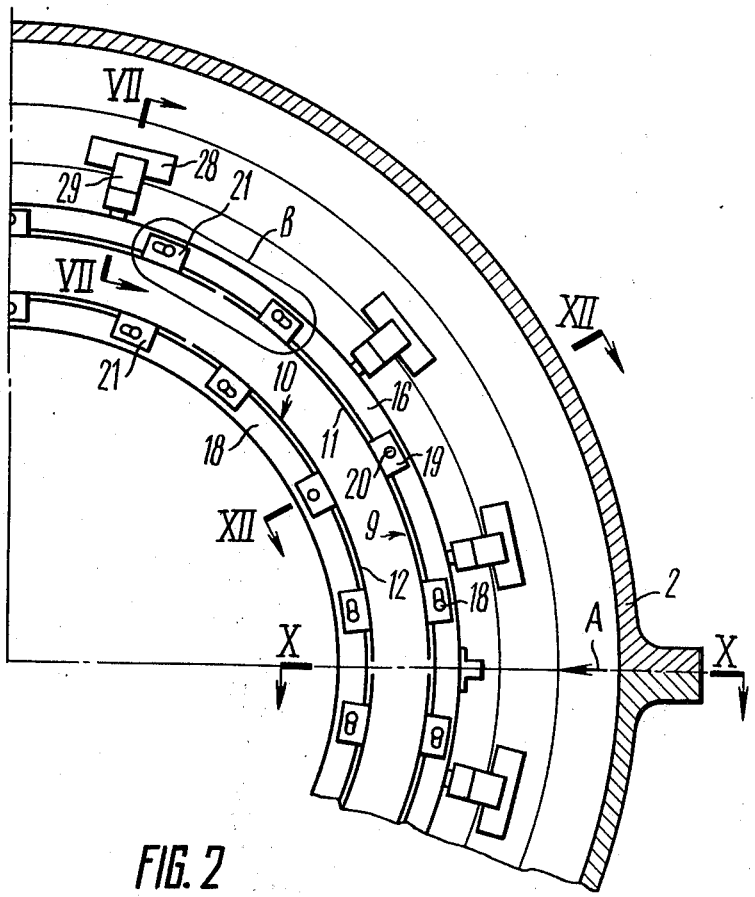
FIG. 2 is a sectional view taken along the line II—II of FIG. 1.
Figure 3:
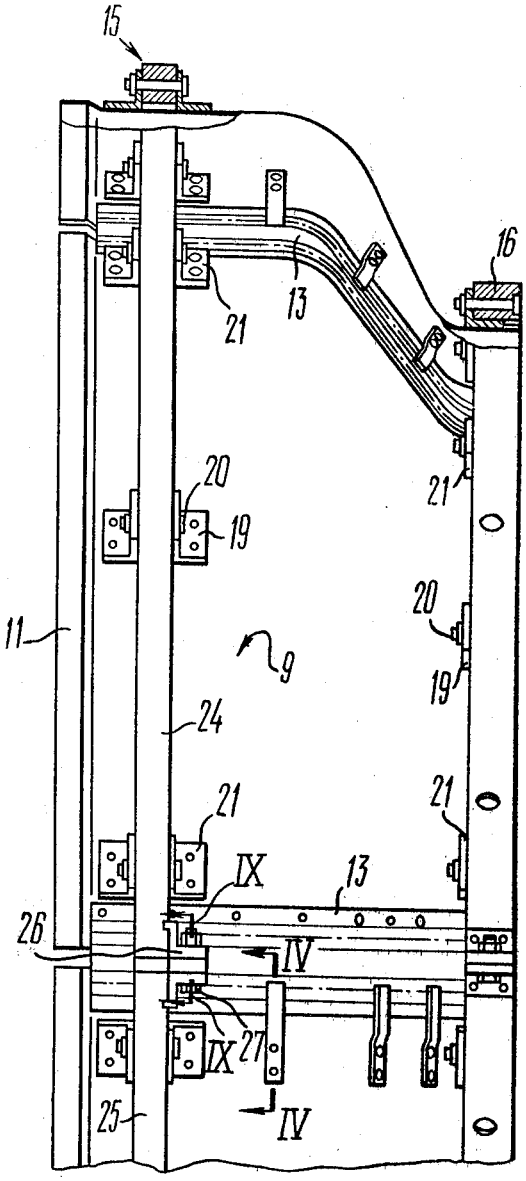
FIG. 3 is a view along the reference arrow A of FIG. 2.

The combustor 1 is made with a longitudinal split coinciding with that of the engine and has a front burner device 6 with gas supply connections 7 mounted in the inlet section of the combustor 1, and a flame tube 8. The latter tube is formed by two concentric, outer 9 and inner 10, shells with curvilinear surfaces, namely, cylindrical surface conjugated with a conical one receding in section in the direction of the gas flow and conjugated with a cylindrical one. Each one of the shells 9 and 10 is split in the longitudinal direction into sections 11 and 12 (FIG. 2), respectively. The places of split are closed throughout the entire length with sealing members in the form of corrugated springs 13 (FIG. 3), with one end of each spring 13 being fixed on one of the sections 11, while the other end of said spring rests against the adjacent section 11 offering no obstruction to relative thermal expansions of said sections in the circumferential direction. The sealing members on the inner shell 10 are analogous with those described above.

Figure 4:
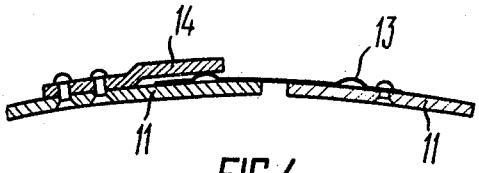
FIG. 4 shows, on an enlarged scale, a sectional view taken along the line IV—IV of FIG. 3.

For a better operation of the spring 13 as a sealing member, provision is made of plates 14 (FIG. 4) attached to the outer section 11 on which the end of the spring 13 rests freely, said plates resting against the corrugations of the spring 13 and spaced from each other over the length of the section.

The sections 11 of the outer shell 9 and sections 12 of the inner shell 10 are secured each on at least two ring-shaped load-bearing members 15, 16 (FIG. 1) and 17, 18, respectively.

Figure 5:
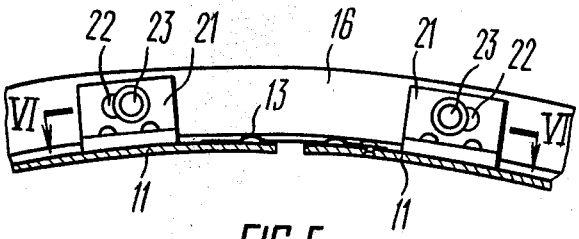
FIG. 5 shows, on an enlarged scale, a fragmentary view B of FIG. 2.
Figure 6:
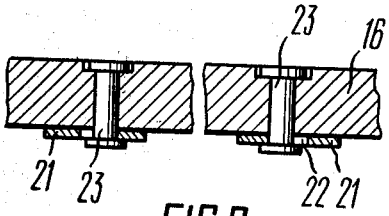
FIG. 6 shows, on an enlarged scale, a section taken along the line VI—VI of FIG. 5.

The sections 11 are attached to the ring-shaped load-bearing members 15, 16 (FIG. 3) in such a manner that the sections 11 in the zone of the ring-shaped load-bearing members 15, 16 are rigidly attached by their middle portions to said load-bearing members with the aid of angles 19 and rods 20 while the ends of the sections are made fast with the aid of angles 21 (FIGS. 5, 6) having oval-shaped holes 22 (FIG. 5) in which rods 23 are receivable mounted in the ring-shaped load-bearing member 16.

As seen from FIGS. 2, 3, 4, 5, the sections 11 are capable of moving in the circumferential direction relative to the ring-shaped load-bearing members 15, 16 (FIG. 3) upon temperature expansion.

The attachment of the sections 12 of the inner shell 10 to the ring-shaped load-bearing members 17, 18 is analogous to that described above with respect to the sections 11.

The arrangement of the ring-shaped load-bearing members 15, 16, 17, 18 (FIG. 1) will become clear upon considering the ring-shaped load-bearing member 15 (FIG. 3), the rest being analogous. The ring-shaped load-bearing member 15 consists of two halves 24 and 25 rigidly interconnected over the split by means of, say, angles 26, each of which is attached to each one of the halves 24 and 25. The angles are coupled with each other by means of bolts 27 to provide for rigid separable joint of both halves.

Figure 8:
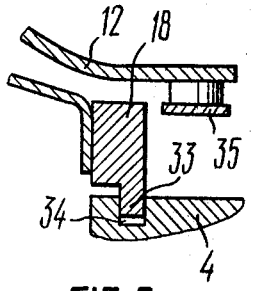
FIG. 8 shows, on an enlarged scale, a fragmentary view C of FIG. 1.
Figure 7:
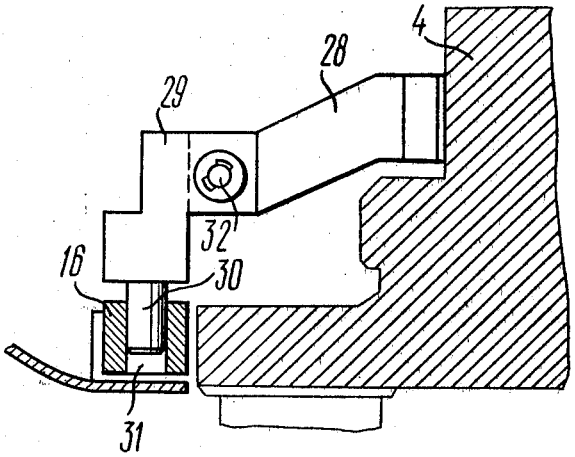
FIG. 7 shows, on an enlarged, scale a sectional view, generally taken along the line VII—VII of FIG. 2.

The ring-shaped load-bearing members 16, 18 (FIG. 1) located in the zone of the outlet section of the combustor 1 are free to move radially relative to the housing 4 of the gas turbine stator 5. This free radial movement, for example, in the case of the ring-shaped load-bearing member 16, is provided through the use of means including a bracket 28 (FIG. 7) secured with its one end on the housing 4 and provided on its other end with a pin receivable in a groove in a boss 29 whose finger 30 is in turn receivable in a radial hole 31 of the ring-shaped load-bearing member 16. The bracket 28 is coupled with the boss 29 by means of a finger 32 fixed with a lockpin. The ring-shaped load-bearing member 16 is free to move radially with the aid of a shoulder 33 (FIG. 8) made on the member 18 and receivable in an annular groove 34 in the housing 4 to lock the ring-shaped load-bearing member 18 in the longitudinal direction and to provide freedom for its thermal expansion in the radial direction relative to the housing 4. Thermal protection of the housing 4 is provided by shields 35 attached to the sections 12.

Figure 9:
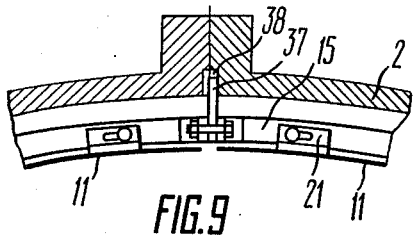
FIG. 9 is a sectional view taken along the line IX—IX of FIG. 3.

The ring-shaped load-bearing member 15 (FIG. 1) located in the zone of the inlet section of the combustor 1 is capable of longitudinal and radial movement relative to the casing 2. To this end, in the plane of the split of the member 15, there are secured cleats 37 (FIG. 9) located in a socket 38 of the flange of the longitudinal split of the casing 2 with a radial gap 39 (FIG. 10) and a longitudinal gap 40.

The ring-shaped load-bearing member 17 (FIG. 1) located in the zone of the inlet section of the combustor 1 is capable of longitudinal and radial movement relative to the diffusor 3. To this end, in the plane of the split of the member 17 (FIG. 11), there are secured cleats 41 located in a socket 42 of the flange of the longitudinal split of the diffusor 3 with a radial gap 43 (FIG. 10) and a longitudinal gap 44.

With a view to increasing the stiffness and strength of the split of the inner shell 10, the latter is reinforced with additional half-rings 45 and 46 (FIGS. 1, 10) connected with said shell in the same way as the ring-shaped load-bearing members 17 and 18. In order to facilitate the disassembly of the combustor 1, the half-rings 45 and 46 are not secured to each other rigidly but only rest against each other in the plane of the split and are locked radially with respect to each other by means of, say, a key joint.

Figure 10:
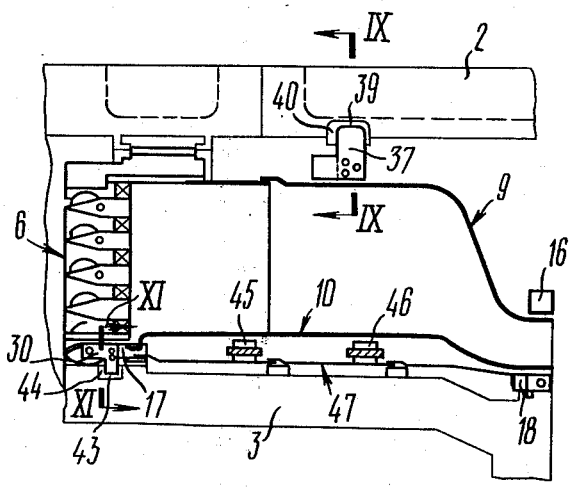
FIG. 10 is a view taken along the line X—X of FIG. 2.
Figure 11:
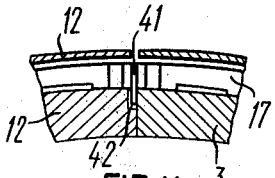
FIG. 11 is a sectional view taken along the line XI—XI of FIG. 10.

In order to reduce the temperature of the diffusor 3, shields 47 are attached to the ring-shaped load-bearing members 17 and 18 and additional half-rings 45 and 46 are disposed between the diffusor 3 and the inner shell 10 (FIG. 10).

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. An annular combustor of a gas turbine engine having a diffusor and a longitudinal split coinciding with a longitudinal split of the engine and comprising: a front burner device located in an inlet section of said annular combustor; a flame tube; an outer shell and an inner shell, both having curvilinear surfaces, concentric with each other, forming said flame tube and being split into sections in the longitudinal direction; sealing members adapted to seal the places of the split; at least two ring-shaped, longitudinally-split load-bearing members for each one of said outer and inner shells, one of said load-bearing members being located in the zone of said inlet section of said combustor and having a provision for longitudinal and radial movements relative to said diffusor, while the other one of said load-bearing members is located in the zone of the outlet section of said combustor and having a provision for radial movement; each one of said longitudinal sections being coupled with a respective one of said ring-shaped, load-bearing members, such that the middle portion of each said section is attached to a ring-shaped member while the ends of said section are connected to the ring-shaped member with provision for movement in the circumferential direction.

2. The annular combustor according to claim 1, including shields attached to said ring-shaped, load-bearing members; and additional half-rings disposed between said diffusor and the inner shell are connected with said inner shell so as to increase the stiffness and strength of the split of said inner shell.

* * * * *